US008413263B2

(12) United States Patent
Crimi et al.

(10) Patent No.: US 8,413,263 B2
(45) Date of Patent: Apr. 9, 2013

(54) CAPE HAVING AN EXPANDABLE TRANSPARENT COMPARTMENT

(76) Inventors: Michael Crimi, Ocala, FL (US); Danny Moreno, Ocala, FL (US)

( * ) Notice: Subject to any disclaimer, the term of this patent is extended or adjusted under 35 U.S.C. 154(b) by 192 days.

(21) Appl. No.: 12/824,290

(22) Filed: Jun. 28, 2010

(65) Prior Publication Data

US 2010/0325767 A1 Dec. 30, 2010

Related U.S. Application Data

(60) Provisional application No. 61/220,926, filed on Jun. 26, 2009.

(51) Int. Cl.
*A41D 13/04* (2006.01)

(52) U.S. Cl.
USPC ..... 2/50

(58) Field of Classification Search ..... 2/50, 88, 2/48, 51, 87, 84, 94, 247, 249, 250, 69, 85, 2/89, 93, 108, 251, 252, 253, 254, 115
See application file for complete search history.

(56) References Cited

U.S. PATENT DOCUMENTS

| | | | | |
|---|---|---|---|---|
| 913,694 | A * | 3/1909 | Carpenter | 2/88 |
| 2,540,448 | A * | 2/1951 | Karow | 2/87 |
| 2,688,752 | A * | 9/1954 | Sbarra et al. | 2/113 |
| 2,932,034 | A * | 4/1960 | Carroll | 2/88 |
| 3,055,133 | A * | 9/1962 | Anderson | 40/586 |
| 4,060,853 | A * | 12/1977 | Gabarro | 2/108 |
| 4,202,053 | A * | 5/1980 | Bell | 2/84 |
| 5,953,753 | A | 9/1999 | Perez | |
| 2006/0075537 | A1 * | 4/2006 | Tsai | 2/69 |
| 2006/0206990 | A1 * | 9/2006 | Demus | 2/247 |
| 2007/0245444 | A1 * | 10/2007 | Brink | 2/69 |
| 2009/0094725 | A1 * | 4/2009 | Smith et al. | 2/69 |
| 2010/0175161 | A1 * | 7/2010 | Jarboe | 2/69 |
| 2010/0287677 | A1 * | 11/2010 | Alexander | 2/50 |

FOREIGN PATENT DOCUMENTS

| | | | |
|---|---|---|---|
| CN | 201468054 U | * | 5/2010 |
| CN | 202135724 U | * | 2/2012 |

* cited by examiner

*Primary Examiner* — Amy Vanatta

(74) *Attorney, Agent, or Firm* — Timothy H. Van Dyke; Beusse, Wolter, Sanks, Mora & Maire, P.A.

(57) ABSTRACT

Disclosed herein is a cape useful in the hairstyling arts. The cape includes a pouch that is configured to allow viewing of an object under the cape while preventing hair and other debris from entering the interior of the cape. The pouch is configured to open from a fastened position where it is flush with the outer surface of the cape to an expanded position wherein a transparent window integral with the pouch allows viewing of objects through the cape.

10 Claims, 5 Drawing Sheets

CAPE HAVING AN EXPANDABLE TRANSPARENT COMPARTMENT

RELATED APPLICATIONS

This application claims priority to U.S. Ser. No. 61/220,926 filed Jun. 26, 2009, which is incorporated herein in its entirety.

FIELD OF THE INVENTION

The invention generally relates to capes used during a hair cut, and more specifically, to a cape having an expandable transparent compartment for viewing an object during the hair cut.

BACKGROUND OF THE INVENTION

Capes used during hair cutting are well known, and are typically worn by a customer in a barber shop or hair salon, whose hair is to be cut. The customer sits in a chair and the barber or hair stylist positions the cape over the body of the customer, and wraps a top portion of the cape around the neck of the customer. The cape is typically made of a dark, non-transparent, water proof material, which provides a buffer from falling cut hair, water, and other debris during the hair cut from contacting the customer's clothes and body.

U.S. Pat. No. 5,953,753 to Perez discloses such a conventional cape used during a hair cut and including a feature which prevents cut hair from clogging the neck closure. Additionally, the cape has a resiliently connected toy which can be accessible for play by a child.

Although conventional capes, such as the cape disclosed in Perez, disclose a cape which prevents debris such as cut hair and water from contacting the customer during the hair cut, these conventional capes have several shortcomings Depending on the type of hair cut, the duration of a hair cut may be extensive. Since the nature of the hair cutting capes require that the customer keep their hands below the surface of the cape during the hair cut, the customer cannot entertain themselves by reading a book, for example. When this limitation is compounded with the possibility of a hair cut having a long duration, the customer is likely to encounter long stretches of boredom.

Accordingly, it would be advantageous to optimize these capes, such that such long stretches of boredom encountered during a hair cut are avoided.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

According to certain embodiments, the invention pertains to a cape for positioning over a user during a hair cut, and which allows viewing of objects positioned under the cape. The cape includes a securable collar portion at a top end of the cape for positioning the cape around a neck of the user; a cape body portion; and a pouch associated with the cape body portion, the pouch being accessible from an inside surface of the cape body portion. The pouch includes a transparent window through which an object may be held by the user in said pouch and viewed through said transparent window during said hair cut.

In a specific embodiment, the pouch is expandable from a fastened position, wherein a pouch flap portion is secured against said cape body portion with a selective amount of pouch material sealed interior within said pouch flap portion, to an expanded position, wherein the selective amount of pouch material is unfurled. The pouch flap portion may be fastened to the cape body portion by a fastener associated with the cape body portion adjacent to the expandable pouch; wherein upon selectively actuating the fastener, the expandable pouch is permitted to assume said expanded position. In a more specific embodiment, the pouch flap portion includes a plurality of segments. Each segment is optionally separated from an adjacent segment by a respective fold within the pouch flap portion, and the fastener is configured to extend along a side of at least one segment of the pouch flap portion.

In a more specific embodiment, the transparent window is configured to be formed within a first segment of the pouch flap portion, such that in said fastened position, a second segment of said pouch material is positioned inwardly relative to said first segment. The fastener is configured to extend along a side of the first segment, to secure the first segment to the cape body portion, such that the second segment is sealed within the pouch flap portion.

In another embodiment, the cape further includes a sealing material segment joining an edge of the first and second segments to an edge of an outer surface of the cape body portion adjacent to the expandable pouch, such that upon unfurling the plurality of segments into the expanded position, the sealing material is configured to form a seal between the outer surface of the cape body portion and the edge of the plurality of segments, to prevent debris from entering said opening during the hair cut.

Figure 1:
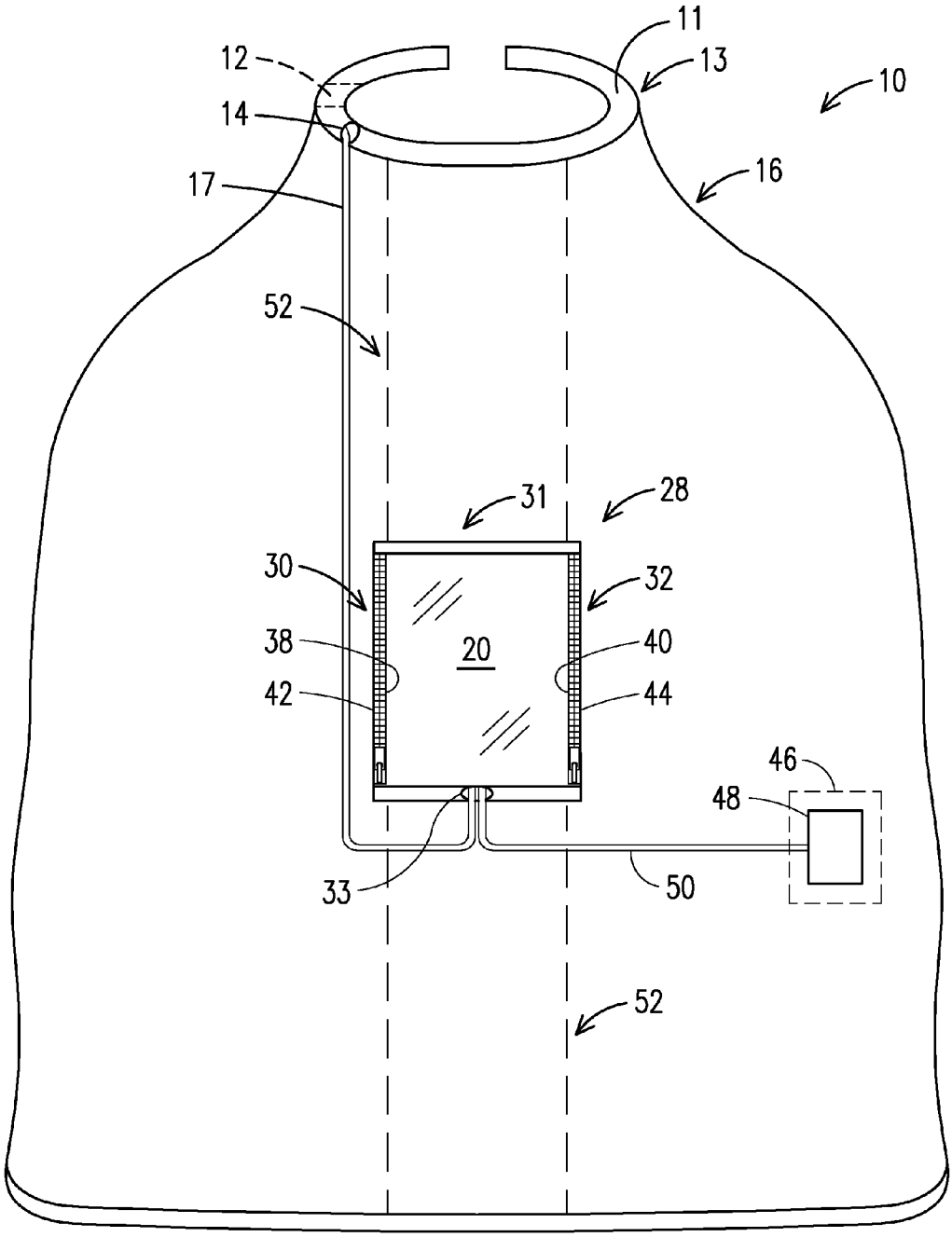
FIG. 1 is a partial cross-sectional view of an outer surface of an exemplary embodiment of a cape having a pouch in accordance with the present invention.

FIG. 1 illustrates an exemplary embodiment of a cape 10 to be positioned over a customer during a hair cut, such as by a barber in a barber shop or a hair stylist in a hair studio, for example. A body portion 16 of the cape 10 is made from a non-transparent, opaque, waterproof material, which shields debris, such as cut hair and water, for example, from contacting the customer during the hair cut. The cape 10 is positioned over the body of the customer, by securing a collar 11 at a top end 13 of the cape 10 around a neck of the customer, and covering the shoulders, arms, torso and part of the lower body with the cape 10. However, the cape 10 need not be secured in any particular way, provided that the customer's body is adequately shielded from the above-mentioned debris routinely-encountered during a hair cut.

As illustrated in FIG. 1, the cape 10 includes a pouch 28 associated with the cape body portion 16. The pouch 28 is accessible from an inside surface of the cape body portion 16 and includes a transparent window 20 such that an object 18 (FIG. 3) may be held by the user in the pouch 28 and viewed through the transparent window 20 during the hair cut. The pouch 28 includes a pouch flap portion 31 (FIGS. 1-3) which is expandable from a fastened position 18 (FIG. 1) where the perimeter of the transparent window 20 is secured to the cape body portion 16, and a selective amount of pouch material is sealed interior within the pouch flap portion 31, to an expanded position 21 (FIGS. 2-3), where a selective amount of the perimeter of the transparent window 20 is detached from the cape body portion 16, and a selective amount of pouch material is unfurled from the pouch flap portion 31. Although FIG. 1 indicates that a pair of sides 30,32 of the transparent window 20 are removably secured from the cape body portion 16, this is merely an exemplary embodiment, and any selective amount of the perimeter of the transparent window may be detached from the cape body portion. Additionally, the entire perimeter of the transparent window need not be secured to the cape body portion in the fastened position, provided that the pouch flap portion is still capable of expanding from the fastened position to the expanded position, as discussed in further detail below. Additionally, the above language is meant to encompass the transparent window itself, or a segment of the pouch flap portion into which the transparent window is formed, as discussed in further detail below.

Figure 2:
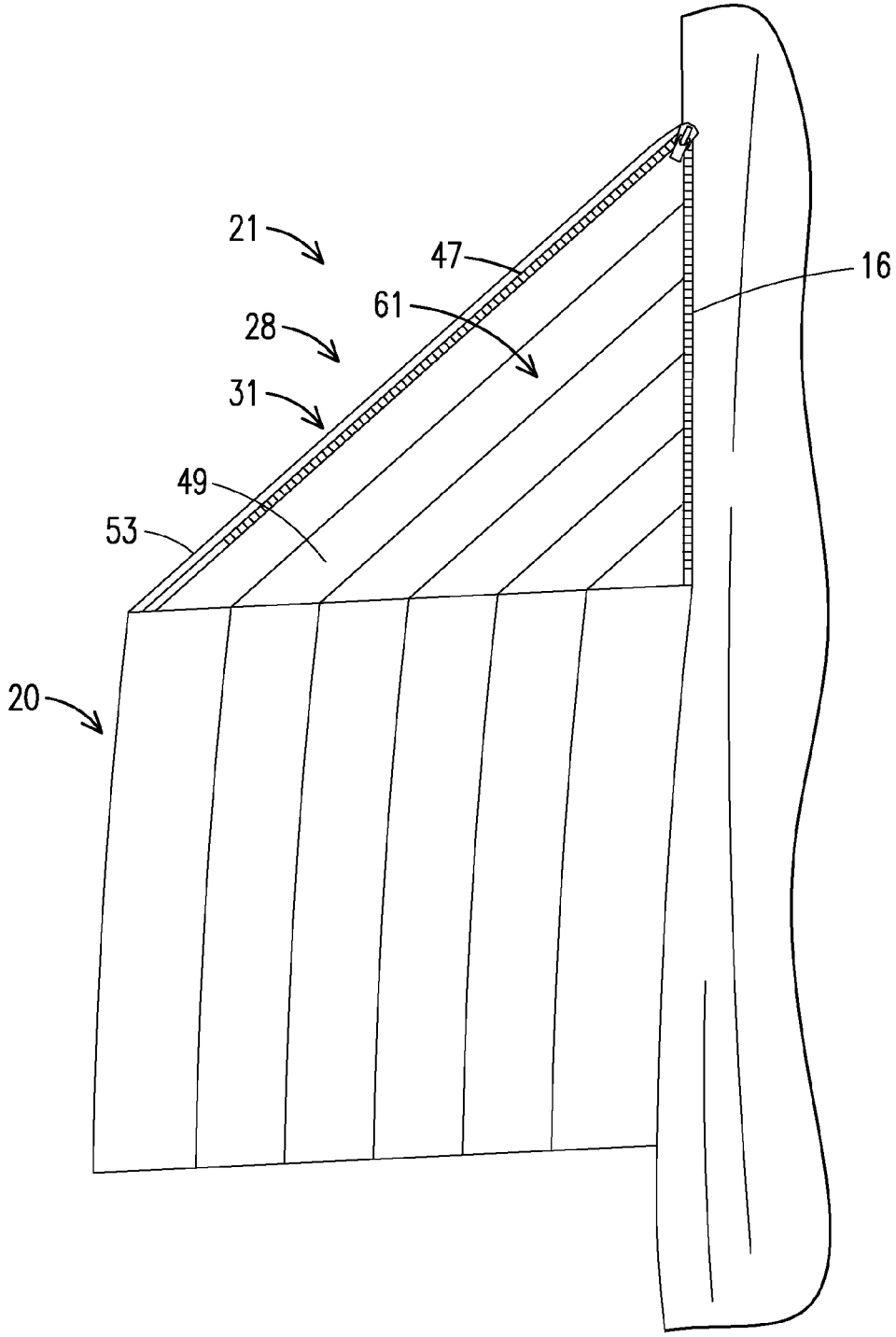
FIG. 2 is a side perspective view of a transparent window of the pouch illustrated in FIG. 1 in an expanded position.
Figure 3:
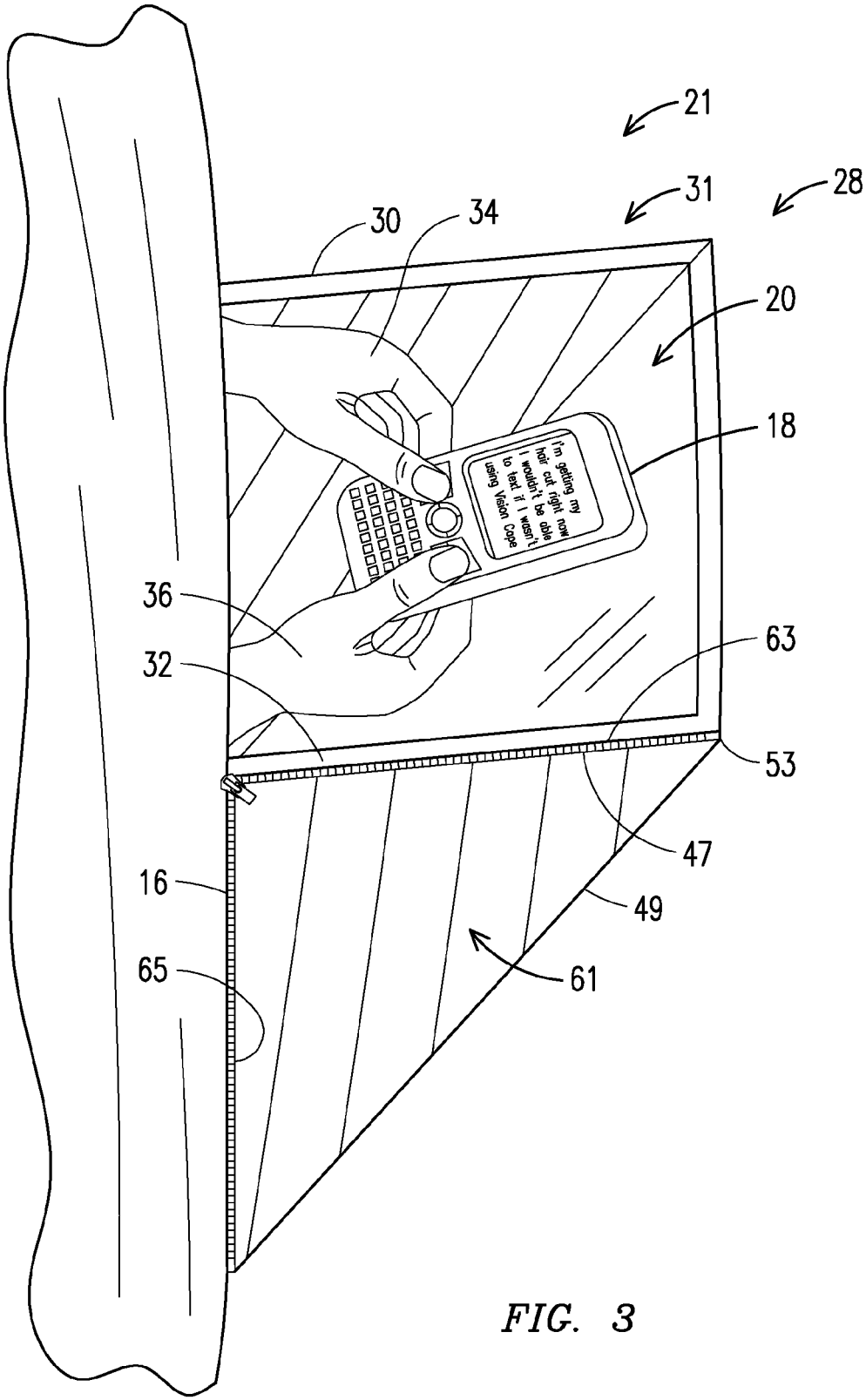
FIG. 3 is the side perspective view of the transparent window of the pouch illustrated in FIG. 2, with an object held within the pouch by two hands of a user.

As illustrated in FIGS. 2-3, the pouch flap portion 31 includes segments 47,49, where the segments 47,49 are separated from each other by a fold 53 within the pouch flap portion 31. In the illustrated exemplary embodiments of FIGS. 1-4, the transparent window 20 is formed in the segment 47 of the pouch flap portion 31. Although FIGS. 1-4 illustrate a pouch flap portion 31 having two segments 47,49, the pouch flap portion 31 may have more than two segments, such as one segment into which the transparent window is formed, and a pair of segments folded on an inner side of the transparent window in the fastened position, for example.

In the fastened position 18 (FIG. 1), the segment 47 of the flap pouch portion 31 includes two sides 30,32 along which a respective fastener 38,40 is extended. In an exemplary embodiment, the fastener may be a zipper, for example, or any fastener capable of removably detaching the perimeter of the segment 47 from the cape body portion 16, such as any hook-and-loop fastener, such as Velcro®, for example. The segment 47 of the pouch flap portion 31 is fastened to the cape body portion 16 by fastening a respective fastener 42,44 secured to an edge of the cape body portion 16, adjacent to the flap pouch portion 31, to the respective fastener 38,40. The segment 49 is folded on the inner surface of the segment 47, using the fold 53. When the segment 47 of the flap pouch portion 31 is secured to the cape body portion 31 (using the fasteners 38,40 and 42,44), the selective amount of the pouch material is sealed within the pouch flap portion 31.

Figure 4:
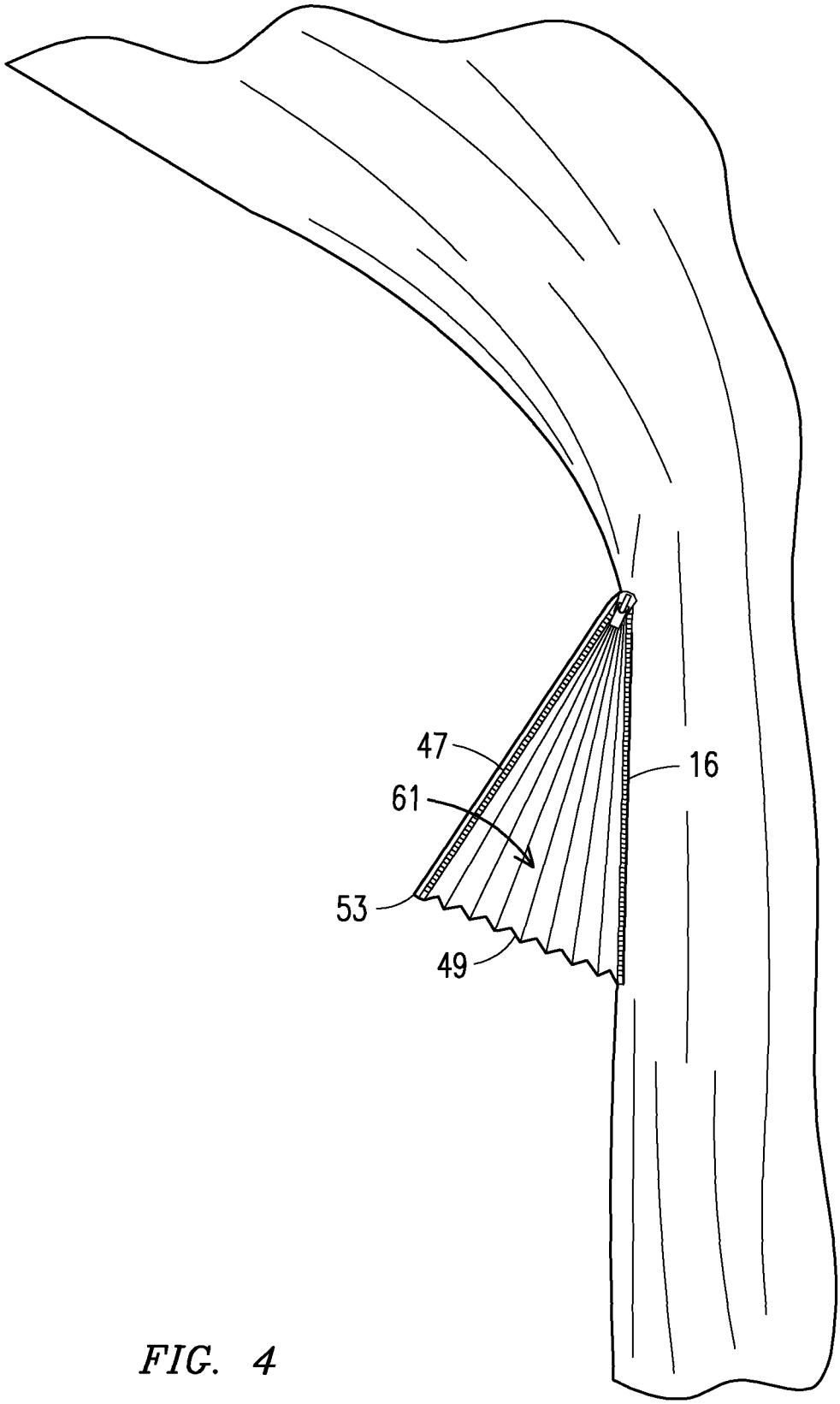
FIG. 4 is a side view of the pouch illustrated in FIG. 1 in an intermediate position between a fastened position and the expanded position illustrated in FIG. 2.

When the user wants to view an object 18 (FIG. 3) through the transparent window 20 during a hair cut, from the fastened position 18 (FIG. 1), the fastener 38,40 extending along the sides 30,32 of the segment 47 is selectively detached from the fasteners 42,44 of the cape body portion 16. This will permit the segment 49 of the cape body portion 16 to unfold out from behind the inner surface of the segment 47 (FIG. 4), thereby permitting the segment 47 to rotate away from the cape body portion 16 and the fastened position 18, and the pouch flap portion 31 to expand to an intermediate position 22 (FIG. 4). As the user continues to detach the fastener 38,40 of the segment 47 from the fastener 42,44 of the cape body portion 16, the segment 47 and the pouch flap portion 31 expand to an expanded position 21 (FIGS. 2-3), in which the segment 49 has fully unfolded from behind the segment 47 (via. fold 53), such that the segment 47 faces the user and the selective amount of pouch material within the pouch flap portion 31 is fully expanded. Additionally, as the pouch flap portion 31 expands from the fastened position 18 to the expanded position 21, a sealing material 61 expands between an edge 63 of the segments 47,49 and an edge 65 of an outer surface of the cape body portion 16 adjacent to the pouch 28. The sealing material 61 forms a seal between the edges 63,65, to prevent debris from entering between the edges 63,65 during the hair cut, when the pouch flap portion 31 is in the expanded position 21. Additionally, in a more specific embodiment, once the pouch 28 has reached the expanded position 21, a stay mechanism lining the segment 47, cape body portion 16 and the sealing material 61, provides internal strength and rigidity to ensure that the pouch 28 does not prematurely collapse from the expanded position 21 onto the user's hands while the user is holding the object 18 within the pouch 28. This stay mechanism comprises a flexible wiring, for example, but not limited to wiring material made of metal or plastic.

In an exemplary embodiment, the user selectively actuates the fastener 38,40 of the segment 47 and fastener 42,44 of the cape body portion 16, to selectively expand the pouch flap portion 31, based on a size of the object 18 to be position in the pouch 28. For example, if the object 18 is a small cell-phone, the user may actuate a small extent of the fasteners 38,40 of the segment 47 and fasteners 42,44 of the cape body portion 16, since a relatively small pouch 28 is desired and thus the pouch flap portion 31 need only expand by a small extent. However, if the object 18 is a large magazine, for example, the user may actuate a large extent of the fasteners 38,40 of the segment 47 and fasteners 42,44 of the cape body portion 16, since a relatively large pouch 28 is desired and thus the pouch flap portion 31 needs to expand by a large extent. The user may view any objects within the pouch, such as cell-phones, mobile movie players, mobile video game systems, books, magazines, and any electronic media, for example.

As illustrated in FIG. 1, in an exemplary embodiment of the present invention, the cape 10 may include an optional secondary pouch 46 positioned beneath the cape body portion 16 of the cape 10. The secondary pouch 46 holds a secondary object 48 to the object 18, such as an electro-acoustic transducer or speaker, for example. In an exemplary embodiment, the object 18 may be an electronic device positioned in the pouch 28 which is electrically coupled to the secondary object 48, which may be the electro-acoustic transducer, to transmit an electric signal to the electro-acoustic transducer, such that the electro-acoustic transducer is configured to output an audio signal based on the transmitted electric signal. As illustrated in FIG. 1, an opening 33 may be provided in the pouch 28, to receive an electrical cable 50 which is coupled to the object 18, and is received through an opening (not shown) in the secondary pouch 46, and coupled to the secondary object 48, which may be the electro-acoustic transducer. Although this exemplary embodiment of the present invention discusses that the secondary object 48 may be an electro-acoustic transducer, the secondary object 48 may be a secondary book or a secondary electronic device (e.g., cell-phone, video game device, portable TV/movie player, etc). In an exemplary embodiment, the secondary object 48 may remain within the secondary pouch 46 as each customer uses the cape 10, and, as each customer inserts a different object 18 into the pouch 28, and, if the object 18 is an electronic object, each customer may couple the respective object to the secondary object 48 using the electrical cable 50. However, in an exemplary embodiment, each customer who uses the cape 10 may use the same object 18 which may remain in the pouch 28, for example. In an additional exemplary embodiment, as illustrated in FIG. 1, a secondary object 12 may be inserted within the collar 11 of the cape 10. The secondary object 12 may be an electro-acoustic transducer or speaker, as with the secondary object 48 discussed above, and would be sized to fit within a cavity of the collar 11, preferably adjacent to or beneath the ears of the user while the user wears the cape 10. The opening 33 provided in the pouch 28 may receive an electrical cable 17 (similar to the electrical cable 50 above) which is coupled to the object 18, and is received through an opening 14 in the collar 11 and coupled to the secondary object 12. In an alternate exemplary embodiment, the secondary object 12 may be a retracting ear piece, from which a pair of headphones (not shown) extend from the opening 14 to be placed in the ears of the user 14, to listen to music outputted from the object 18, such as a CD-player, for example. The secondary object 12 may be coupled to the object 18 within the pouch 28 using the electrical cable 17, or the secondary object 12 may be coupled to a secondary electrical device (not shown) positioned within the collar 11, for example, which may transmit acoustical data which is output over the headphones. As illustrated in FIG. 1, the pouch 28 may be selectively positioned within the cape 10, based on a region 52 of the cape 10 corresponding to a reading line of sight of a customer while seated and wearing the cape 10. As illustrated in FIG. 1, the region 52 may be adjacent to a centerline of a front side of the cape 10, and more specifically, may be aligned with a centerline of a torso of a customer while seated and wearing the cape. As appreciated by one of skill in the art, a barber or hair stylist may occasionally ask the customer to turn their heads to various orientations. In an exemplary embodiment, the cape 10 is adequately sized such that the customer may shift the pouch 28 and their hands 34,36 (FIG. 3) within the pouch 28 to correspond with a new line of sight (which may or may not correspond with the region 52).

Figure 5:
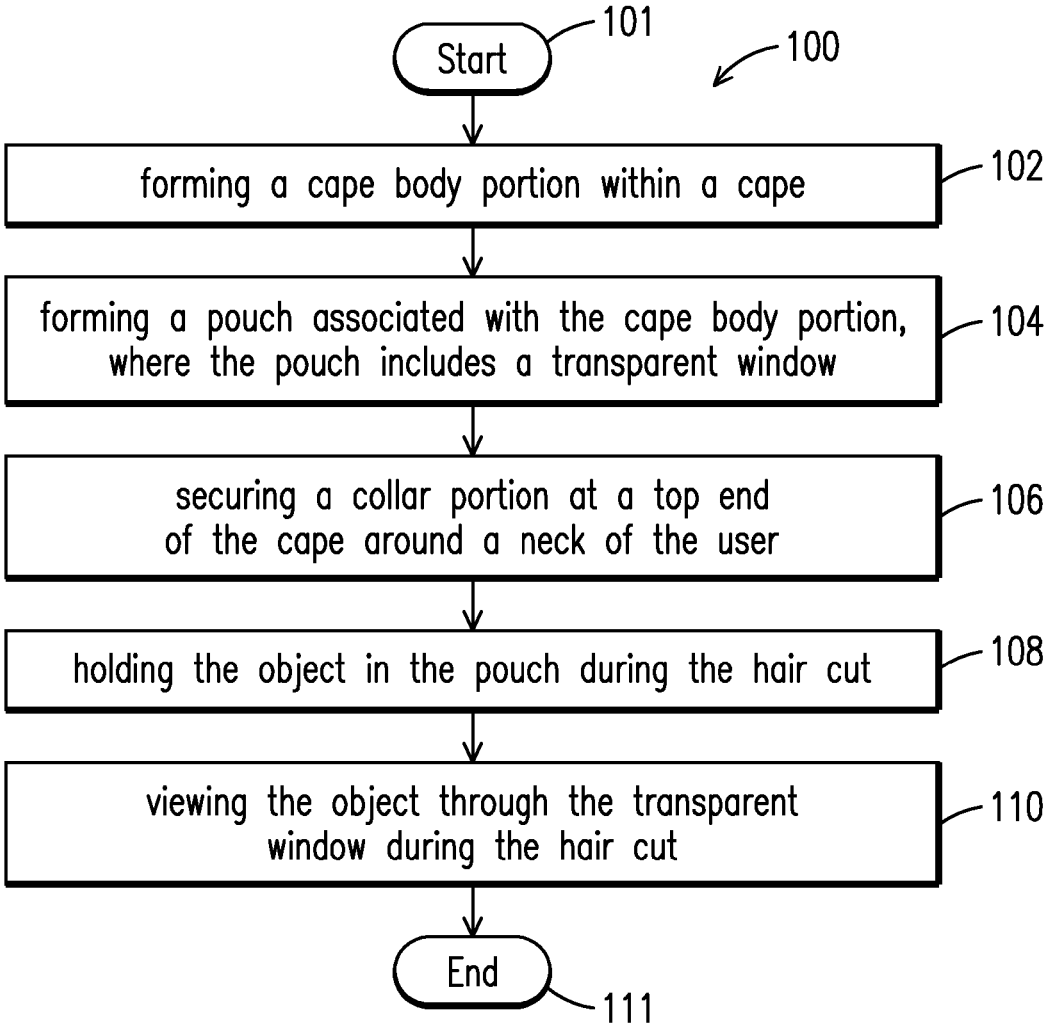
FIG. 5 is a flowchart depicting an exemplary embodiment of a method for positioning a cape over a user during a hair cut in accordance with the present invention.

FIG. 5 illustrates a flowchart depicting a method 100 for positioning the cape 10 over a user during a hair cut. The method 100 begins at 101 by forming 102 the cape body portion 16 within the cape 10. The method 100 further includes forming 104 the pouch 28 associated with the cape body portion 16, where the pouch 28 includes a transparent window 20. The method 100 further includes securing 106 a collar portion 11 at a top end of the cape 10 around a neck of the user. The method 100 further includes holding 108 the object 18 in the pouch 28 during the hair cut, and viewing 110 the object 18 through the transparent window 20 during the hair cut, before ending at 111.

The teachings of the references cited throughout the specification are incorporated herein in their entirety by this reference to the extent they are not inconsistent with the teachings herein. It should be understood that the examples and the embodiments described herein are for illustrative purposes only and that various modifications or changes in light thereof will be suggested to persons skilled in the art and are to be included within the spirit and purview of this application.

What is claimed is:

1. A cape for positioning over a user during a hair cut, said cape comprising:

a securable collar portion at a top end of said cape for positioning said cape around a neck of the user;

a cape body portion; and a pouch associated with said cape body portion, the pouch being accessible from an inside surface of said cape body portion and comprising a transparent portion such that an object may be held by the user in said pouch and viewed through said transparent portion during said hair cut, wherein said pouch comprises a pouch flap portion, said pouch flap portion comprising a plurality of segments, where each segment is separated from an adjacent segment by a respective fold within said pouch flap portion, wherein said pouch is expandable from a fastened position, wherein said pouch flap portion is secured against said cape body portion with a selective amount of pouch material sealed interior within said pouch flap portion, to an expanded position, wherein said selective amount of pouch material is unfurled, and wherein said pouch flap portion is fastened to the cape body portion by a fastener associated with the cape body portion adjacent to the expandable pouch; wherein upon selectively actuating the fastener, the expandable pouch is permitted to assume said expanded position.

2. The cape of claim 1, wherein the transparent portion is configured to be formed within a first segment of the pouch flap portion; wherein in said fastened position, a second segment of said pouch material is positioned inwardly relative to said first segment, and the fastener is configured to extend along a side of the first segment, to secure the first segment to the cape body portion, such that said second segment is sealed within the pouch flap portion.

3. The cape of claim 1, wherein the transparent portion is configured to be formed within a first segment of the pouch flap portion; wherein in said expanded position, upon selectively actuating said fastener configured to extend along the side of the first segment, a selective amount of the first segment is configured to extend beyond an outer surface of the cape body portion and permit the second to segment to unfurl, thereby permitting the expandable pouch to assume said expanded position beyond the outer surface of the cape body portion.

4. The cape of claim 3, wherein in said expanded position, said first segment forms a near portion of the pouch relative to the user such that the user may view an object through said transparent portion.

5. The cape of claim 1, wherein the fastener is selectively actuated by the user, to selectively expand the pouch, based on a size of the object to be positioned within the pouch.

6. The cape of claim 1, wherein said cape further includes:

a sealing material segment joining an edge of the first and second segments to an edge of an outer surface of the cape body portion adjacent to the expandable pouch, such that upon unfurling the plurality of segments into the expanded position, said sealing material is configured to form a seal between the outer surface of the cape body portion and the edge of the plurality of segments, to prevent debris from entering the opening during the hair cut.

7. A method for positioning a cape over a user during a hair cut, said method comprising:

obtaining a cape according to claim 1, securing said collar portion at a top end of said cape around a neck of the user;

holding an object in said pouch during said hair cut; and viewing said object through said transparent portion during said hair cut.

8. The method of claim 7, further comprising opening said pouch from a fastened position to an expanded position.

9. A cape for positioning over a user during a hair cut, said cape comprising:

a securable collar portion at a top end of said cape for positioning said cape around a neck of the user;

a cape body portion;

a first pouch associated with said cape body portion, the first pouch being accessible from an inside surface of said cape body portion and comprising a transparent portion such that an object may be held by the user in said pouch and viewed through said transparent portion during said hair cut, wherein said pouch is expandable from a fastened position, wherein a pouch flap portion is secured against said cape body portion with a selective amount of pouch material sealed interior within said pouch flap portion, to an expanded position, wherein said selective amount of pouch material is unfurled; and a second pouch associated with said cape body portion, and accessible from said inside surface of said cape body portion, wherein said pouch flap portion is fastened to the cape body portion by a fastener associated with the case bad portion adjacent to the expandable pouch; wherein upon selectively actuating the fastener, the expandable pouch is permitted to assume said expanded position, and wherein said pouch flap portion comprises a plurality of segments, where each segment is separated from an adjacent segment by a respective fold within said pouch flap portion, and wherein said fastener is configured to extend along a side of at least one segment of the pouch flap portion.

10. The cape of claim 9, wherein the transparent portion is configured to be formed within a first segment of the pouch flap portion; wherein in said fastened position, a second segment of said pouch material is positioned inwardly relative to said first segment, and the fastener is configured to extend along a side of the first segment, to secure the first segment to the cape body portion, such that said selective amount of pouch material is sealed within the pouch flap portion.

* * * * *